US008517492B2

(12) United States Patent
Nishimura

(10) Patent No.: US 8,517,492 B2
(45) Date of Patent: Aug. 27, 2013

(54) DROPLET PROPELLING DEVICE

(75) Inventor: Asayo Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 297 days.

(21) Appl. No.: 13/030,167

(22) Filed: Feb. 18, 2011

(65) Prior Publication Data

US 2011/0211002 A1 Sep. 1, 2011

(30) Foreign Application Priority Data

Feb. 26, 2010 (JP) ..... P2010-041785

(51) Int. Cl.
*B41J 29/38* (2006.01)

(52) U.S. Cl.
USPC ..... 347/10; 347/9; 347/11

(58) Field of Classification Search
USPC ..... 347/10, 6, 8, 9, 11, 19
See application file for complete search history.

(56) References Cited

U.S. PATENT DOCUMENTS

| | | | | |
|---|---|---|---|---|
| 5,172,142 | A * | 12/1992 | Watanabe et al. | 347/14 |
| 6,824,238 | B2 * | 11/2004 | Chang | 347/10 |
| 7,374,263 | B2 * | 5/2008 | Hosono | 347/8 |
| 2004/0155915 | A1 * | 8/2004 | Kitami et al. | 347/10 |
| 2006/0125856 | A1 | 6/2006 | Kitami et al. | |

FOREIGN PATENT DOCUMENTS

| | | | |
|---|---|---|---|
| EP | 1 147 896 | A2 | 10/2001 |
| EP | 2 039 515 | A1 | 3/2009 |
| JP | 04-369542 | A | 12/1992 |
| JP | 2000-043260 | A | 2/2000 |
| JP | 2000-71444 | A | 3/2000 |
| JP | 2000-255055 | A | 9/2000 |
| JP | 2002-079668 | A | 3/2002 |
| JP | 2002-127418 | A | 5/2002 |
| JP | 2003-246055 | A | 9/2003 |
| JP | 2007-055147 | A | 3/2007 |

OTHER PUBLICATIONS

Extended European search report issued Jun. 1, 2011, in the counterpart European Application No. 11155341.8, six (6) pages.

(Continued)

*Primary Examiner* — Manish S Shah
*Assistant Examiner* — Yaovi Ameh
(74) *Attorney, Agent, or Firm* — Nath, Goldberg & Meyer; Jerald L. Meyer

(57) ABSTRACT

A drive pulse P11 is turned on and off for an ink chamber to take in ink, exerting pressures thereon, and afterward, a drive pulse P12 is turned on and off. This permits, in a course of variation in pressure of ink from a value at a positive pressure peak through a value at a normal pressure to negative pressures, a negative pressure peak C to be amplified for the ink chamber to take in ink with increased power. Further, following the drive pulse P12 tuned off, a drive pulse P13 is turned on to contract a volume in ink chamber 6B, producing pressures. Then, the drive pulse P13 is turned off to enlarge the volume in ink chamber 6B, using back actions of produced pressures to have the ink chamber 6B quickly operate to take in much ink. This causes a subsequent drive pulse P11 to be turned on at a hastened timing, and the drive pulse P13 thus turned on makes a higher increase in pressure of ink in the ink chamber 6B, allowing a subsequent droplet of ink to be more quickly propelled out with an adequate pressure.

4 Claims, 8 Drawing Sheets

(56) References Cited

OTHER PUBLICATIONS

Japanese Office Action Application No. 2010-041785, issued on Sep. 21, 2010, seven (7) pages.

Search Report, in the counterpart Chinese application, issued Feb. 19, 2013, two (2) pages.

Official Action, in the counterpart Chinese application, issued Mar. 4, 2013, five (5) pages.

* cited by examiner

FIG. 9

| | INTERVAL BETWEEN DRIVE PULSES P11, P12 | WIDTH OF DRIVE PULSE P 12 | SATELLITE SUPPRESSING PERFORMANCE | INK DISCHARGE PERFOR-MANCE | TOTAL EVALUA-TION |
|---|---|---|---|---|---|
| PATTERN 1 | 1000ns(0.4) | 800ns(0.32) | × | ○ | × |
| PATTERN 2 | 1000ns(0.4) | 1000ns(0.4) | × | ○ | × |
| PATTERN 3 | 1000ns(0.4) | 1200ns(0.48) | △ | ○ | △ |
| PATTERN 4 | 1000ns(0.4) | 1400ns(0.50) | ○ | ○ | ○ |
| PATTERN 5 | 1000ns(0.4) | 1500ns(0.6) | ◎ | ○ | ◎ |
| PATTERN 6 | 1000ns(0.4) | 1600ns(0.64) | ◎ | △ | △ |
| PATTERN 7 | 1000ns(0.4) | 1800ns(0.72) | ◎ | × | × |
| PATTERN 8 | 1000ns(0.4) | 2000ns(0.8) | ◎ | × | × |

ASSUMING WIDTH OF DRIVE PULSE P11 = 2500ns
VALUES IN PARENTHESES REPRESENT PROPORTIONS TO WIDTH OF DRIVE PULSE P11

FIG. 10

| PULSE \ TEMP. | LOW | STANDARD | HIGH |
|---|---|---|---|
| DRIVE PULSE P0 | LONG | — | SHORT |
| DRIVE PULSE P11 | SHORT | — | LONG |
| INTERVAL BETWEEN DRIVE PULSES P11, P12 | SHORT | — | LONG |
| DRIVE PULSE P12 | SHORT | — | LONG |
| DRIVE PULSE P13 | SHORT | — | LONG |

DROPLET PROPELLING DEVICE

BACKGROUND OF THE INVENTION

1. Field of the Invention

The present invention relates to a droplet propelling device adapted for increasing and decreasing a pressure exerted on ink in an ink chamber to propel out a droplet of ink in the ink chamber through a nozzle communicating with the ink chamber.

2. Description of Related Arts

Inkjet printers have an inkjet head provided with a set of ink chambers each operable by exertion of a pressure to the ink chamber to propel out a droplet of ink in the ink chamber through a nozzle. The droplet of ink propelled out of the nozzle flies with a trailing tail, having a difference in speed developed between a head and the tail at the rear. There may be a droplet developed to have a leading core thereof accompanied by unnecessary fine droplet pieces (referred herein to as "satellites"). Satellites may adhere on a recording medium, degrading the print quality, or adhere on walls of a device, defacing the device.

As a technique to prevent such print quality degradation or device defacement, Patent Literature 1 (JP 2007-55147 A) has proposed using drive signals for driving an inkjet head, including therein paired pulse signals for swelling ink chambers. When driving the inkjet head, drive signals used each work, at a first pulse signal therein, to cause a variation in pressure of ink in an ink chamber, as necessary, to propel a droplet of ink out of the ink chamber, and at a second pulse signal therein, to cause a variation in pressure of ink in the ink chamber, in phase with the variation in pressure of ink caused by the first pulse signal.

When driving the inkjet head, each drive signal used can serve for an ink chamber to have a variation in pressure of ink caused by the second pulse signal, affording to amplify variations in reverberative pressures of ink in the ink chamber. This permits a droplet of ink separated from meniscus to be well defined, effectively preventing emission of satellites.

In recent years, there have been high-speeded inkjet printers, some of them needing propelling a droplet of ink onto a pixel on a recording medium, followed in a short time by consecutively propelling a subsequent droplet of ink onto a neighboring pixel in a transfer direction of the recording medium. There have been also inkjet printers employing a multi-droplet system for consecutively propelling an increased or decreased number of ink droplets onto a single pixel to provide a gradation, needing two or more droplets of ink to be propelled onto the single pixel in a consecutive manner at short intervals of time.

To cope with such the need for ink droplets to be consecutively propelled out, essential is how to quickly arrange a situation that permits a second or any subsequent droplet of ink to be consecutively propelled out with an adequate pressure. Upon such a consecutive propelling of ink droplets, the ink chamber is to have controlled pressures, whereon Patent Literature 2 (JP2002-127418 A) has proposed propelling out a respective droplet of ink, suppressing residual vibrations in the ink chamber. However, as a measure to suppress residual vibrations, there has been proposed no more than controlling ink in the ink chamber to a static pressure, failing to implement quickly propelling out a subsequent droplet of ink with an adequate pressure.

Further, there are inkjet printers operable under low temperature environments, where the viscosity of ink is increased. To this point, for a desirable amount of ink to be discharged, if the inkjet head is driven with increased voltages, it has droplets of ink propelled through nozzles with longer tails. Long tails tend to go disrupt, the longer the more in number of disrupt droplet pieces, with increased tendencies to emit satellites.

Satellites may adhere on a recording medium, degrading the print quality, or adhere on walls of a device, defacing the device. To this point, Patent Literature 3 (JP2000-255055 A) has disclosed proceeding without making any record under low temperature environments having tendencies to emit satellites, to enter a warm-up operation for heating an inkjet head, before starting a record.

However, in such inkjet recording devices under low temperature environments having tendencies to emit satellites, there is a warm-up operation entered before starting a record, thus taking a long time to record an image.

SUMMARY OF THE INVENTION

For an inkjet head to be driven using drive signals including paired pulse signals for propelling droplets of ink suppressing emission of satellites, as described, when consecutively propelling droplets of ink, it is desirable to hold the suppression effect on satellite emission, permitting a subsequent droplet of ink to be propelled out as quickly as possible with an adequate pressure.

The present invention has been devised in view of the foregoing, so it is an object of the present invention to provide a droplet propelling device adapted to have an enhanced efficiency in suppression of satellite emission without interfering with the ink-discharging performance of nozzle, permitting droplets of ink to be consecutively propelled out, allowing a second or any subsequent droplet of ink to be propelled out as quickly as possible with an adequate pressure.

To achieve the object described, according to an aspect of the present invention, there is a droplet propelling device adapted to propel droplets of ink through a nozzle, the droplet propelling device comprising a pressure regulator configured to cause changes in volume of an ink chamber communicating with the nozzle to make increases and decreases in pressure of ink in the ink chamber, and a driver configured to generate a drive signal, and use the drive signal to chive the pressure regulator, the drive signal having a satellite controlling waveform including a first swelling pulse adapted to serve for use of the pressure regulator to cause an increase in volume of the ink chamber for a constant period, a second swelling pulse adapted to serve after an end of the first swelling pulse, interposing a prescribed interval in between, for use of the pressure regulator to cause another increase in volume of the ink chamber for a constant period, and a contracting pulse adapted to serve after an off of the second swelling pulse for use of the pressure regulator to cause a decrease in volume of the ink chamber for a constant period, wherein the driver is configured to turn the second swelling pulse on in a first period that is a period from a first positive pressure peak being a peak of increase in pressure of ink in the ink chamber caused by the first swelling pulse turned on or off to a first negative pressure peak being a peak of decrease in pressure of ink ensuing therefrom, and turn the second swelling pulse off in a second period that is a period from the first negative pressure peak to a second positive pressure peak being a peak of increase in pressure of ink ensuing therefrom, and the driver is configured to work in the second period to turn the contracting pulse on after an off of the second swelling pulse, and turn the contracting pulse off in a period for restoration in pressure of ink in the ink chamber from the second positive pressure peak to a normal pressure value.

BRIEF DESCRIPTION OF DRAWINGS

FIG. 9 is a table listing different patterns each having a fixed interval between a first swelling pulse and a second swelling pulse varied in width, comparing properties associated with ink discharge.

FIG. 10 is a table listing drive pulses in accordance with divisions of ink temperature, describing correction of interval in between.

DETAILED DESCRIPTION OF EMBODIMENTS

There will be described a mode of embodiment of the present invention with reference to the drawings. Like or similar constituent parts or elements will be designated by like or similar reference signs, for simplification with eliminated redundancy.

Figure 1:
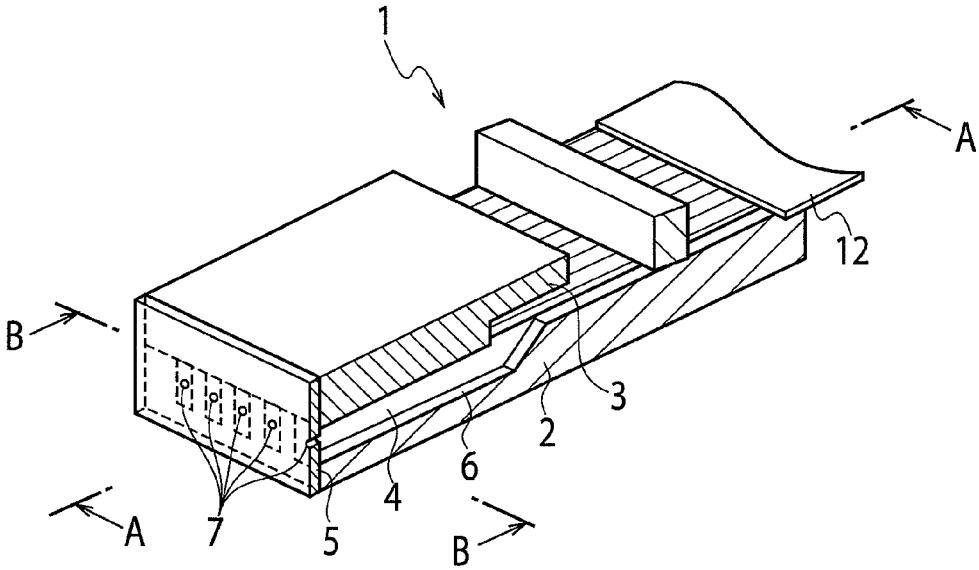
FIG. 1 is a perspective view, partly in section, of an outlined configuration of an inkjet head according to a mode of embodiment of the present invention.
Figure 2:
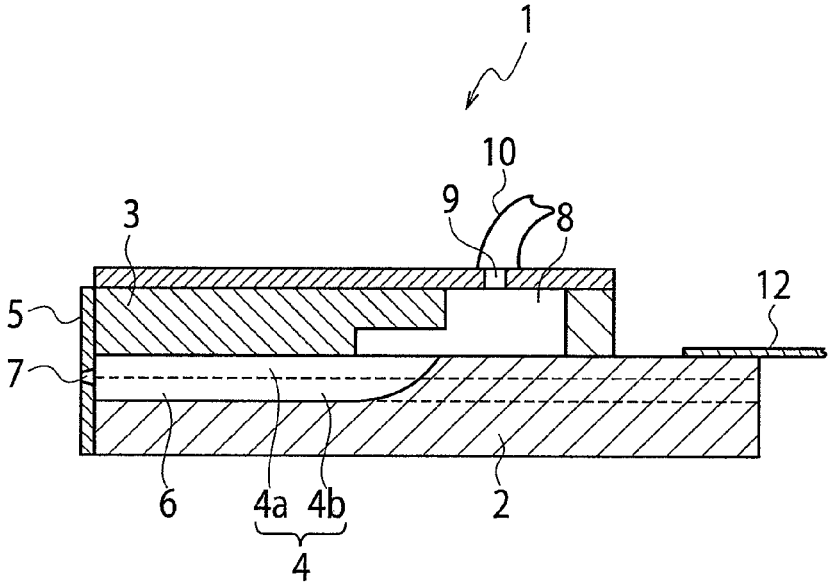
FIG. 2 is a section along line A-A of FIG. 1 showing an ink supply portion of the inkjet head of FIG. 1.
Figure 3A:
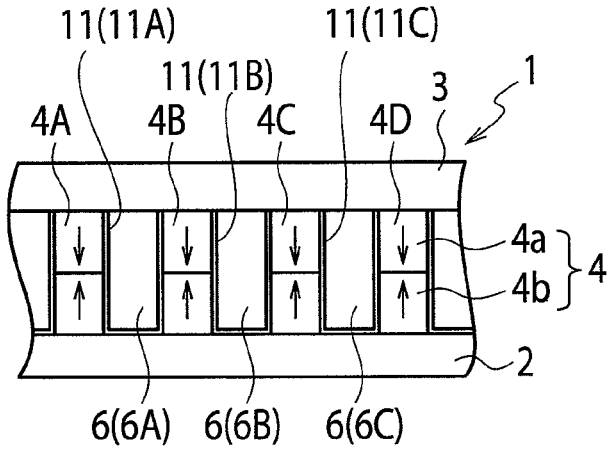
FIGS. 3A to 3C are sections along line B-B of FIG. 1 showing changes in shapes of ink chambers acting to propel droplets of ink in the inkjet head of FIG. 1.
Figure 3B:
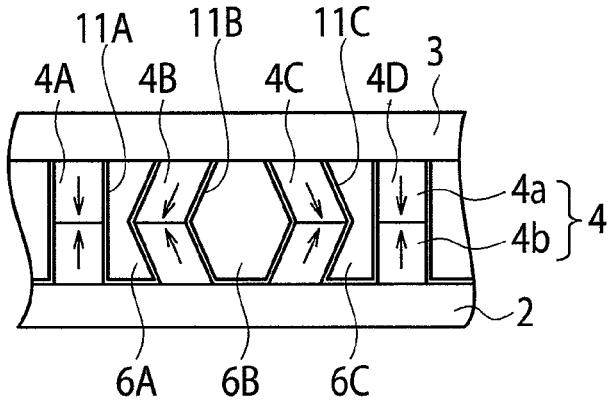
Figure 3C:
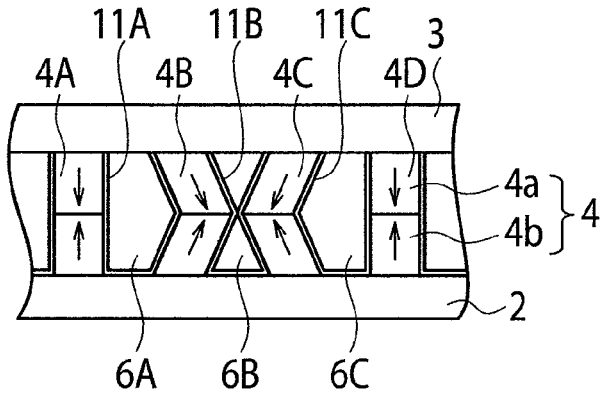

FIG. 1 is a fragmentary sectional perspective view of an outlined configuration of an inkjet head according to a mode of embodiment of the present invention. FIG. 2 is a section along line A-A of FIG. 1 showing an ink supply portion of the inkjet head of FIG. 1. FIGS. 3A to 3C (sometimes collectively referred to as FIG. 3) are sections along line B-B of FIG. 1 showing changes in shapes of ink chambers acting to propel droplets of ink in the inkjet head of FIG. 1. The inkjet head shown in FIG. 1 is a share mode type inkjet head.

As illustrated in FIG. 1 to FIG. 3, there is an inkjet head 1 including, between a substrate 2 made of ceramics or the like and a cover plate 3, an array of partition walls 4 (pressure regulators) each composed of a pair of piezoelectric members 4*a* and 4*b*. Paired piezoelectric members 4*a* and 4*b*, made of a known piezoelectric material such as PZT ($PbZrO_3$—$PbTiO_3$), have their directions of polarization opposing each other as illustrated by arrows in FIG. 3.

The substrate 2, cover plate 3, and partition walls 4 have their distal ends fixed to a nozzle plate 5. There is an array of ink chambers 6 defined by the enclosing combination of substrate 2, cover plate 3, nozzle plate 5, and partition walls 4. The nozzle plate 5 has an array of nozzles 7 formed therethrough. Arrayed nozzles 7 communicate with distal ends of arrayed ink chambers 6, respectively. The ink chambers 6 communicate at their opposite ends with a common ink inlet 8, which in turn is connected through an ink supply port 9 and an ink tube 10 to an ink tank (non-depicted). The ink inlet 8, ink supply port 9, and ink tube 10 cooperatively constitute an ink supply portion of the device.

Each ink chamber 6 is defined at both lateral sides by corresponding surface areas of a pair of neighboring partition walls 4, and at the bottom by a corresponding surface area of the substrate 2, the surface areas having an electrode 11 formed thereon in a tight-adhering manner. At any ink chamber 6, the electrode 11 is extended to cover also lateral sides of rear parts of associated piezoelectric members 4*a*, where it is connected through an anisotropic conductive film (non-depicted) to a conductor in a flexible cable 12. Drive voltages are applied through the flexible cable 12 to the electrode 11.

That is, at any ink chamber 6, there is a sequence of drive voltages applied to an electrode 11 therein, as necessary, causing a pair of associated partition walls 4 to deform in a shearing manner, bringing about changes in volume of the ink chamber 6, and in pressures acting or exerted on ink (sometimes referred herein to simply as pressures of ink) in the ink chamber 6. The ink chamber 6 thus has a volume of ink propelled out as a droplet through an associated nozzle 7.

Figure 4:
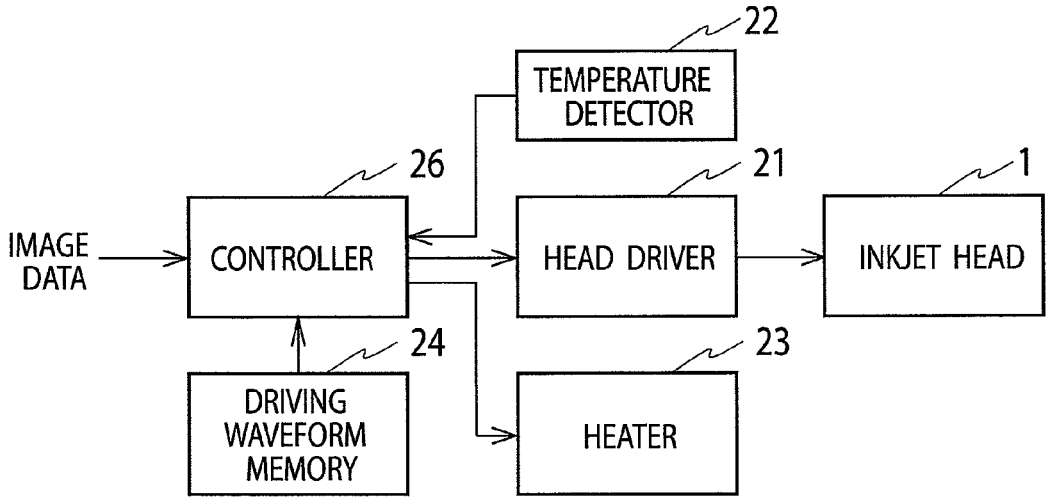
FIG. 4 is a block diagram of functional configuration of an inkjet printer including the inkjet head of FIG. 1.

FIG. 4 is a block diagram of functional configuration of an inkjet printer including the inkjet head of FIG. 1. According to the present mode of embodiment, the inkjet printer includes a head driver 21 for driving the inkjet head 1, a temperature detector 22, a heater 23, a driving waveform memory 24, and a controller 26.

The head driver 21 is configured for an ink discharge drive to have sequences of drive voltages applied through the flexible cable 12 to electrodes 11 in the inkjet head 1, as necessary, to cause associated partition walls 4 to deform, bringing about sequential changes in volumes of corresponding ink chambers 6 and pressures of ink in the ink chambers 6, thereby propelling droplets of ink through corresponding nozzles 7.

The temperature detector 22 is configured to detect a temperature of ink to be supplied to the inkjet head 1. The temperature detector 22 may be installed anywhere it can detect a temperature of ink being supplied from an ink tank (non-depicted) to the inkjet head 1.

The heater 23 is configured to heat ink to be supplied to the inkjet head 1. The heater 23 may be installed anywhere it can heat ink being supplied from the ink tank to the inkjet head 1.

The driving waveform memory 24 is configured to store therein data on waveforms including a set of normal waveforms and a set of satellite controlling waveforms of voltages for driving the inkjet head 1. A standard pattern of normal waveform and different patterns of satellite controlling waveforms will be described later on.

The controller 26 is configured to determine a normal waveform or a satellite controlling waveform, whichever is selective, as a waveform of each drive signal to be used, taking into consideration, among others, a result of detection at the temperature detector 22, and concerned data such as type of print sheet input from an operation panel (non-depicted) or the like. The controller 26 is configured to control the head driver 21 to output a set of drive signals of selected waveforms to electrodes 11 in the inkjet head 1, as necessary. Each drive signal output from the head driver 21 serves to propel out a single droplet of ink, at an ink chamber 6B where it is received by an electrode 11B therein. The controller 26 is configured to control operations of the heater 23, as well.

Description is now made of fundamental actions for ink discharge.

Figure 5A:
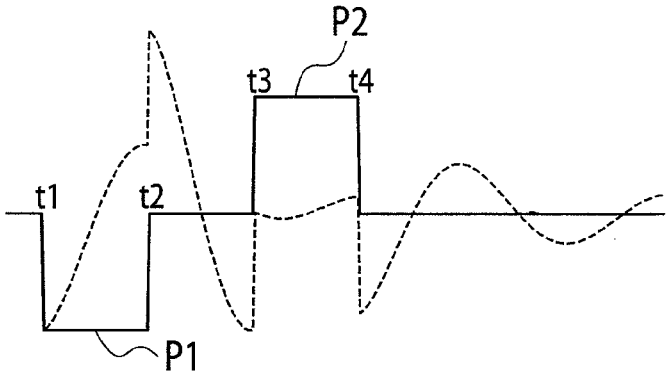
FIG. 5A is a diagram describing a relationship between a drive signal having a normal waveform, and a variation in pressure of ink in an ink chamber driven by the drive signal in the inlet head of FIG. 1.
Figure 5B:
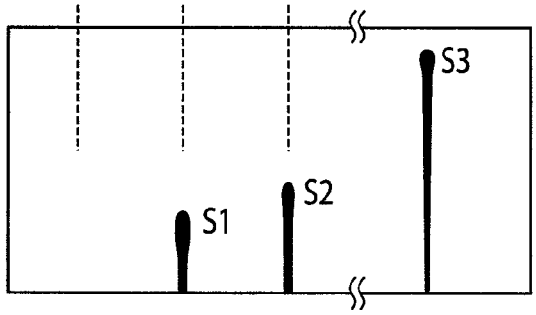
FIG. 5B is a diagram describing a transition in shape of a droplet of ink.

FIG. 3 illustrates actions of four pairs of piezoelectric members 4*a* and 4*b* that constitute four partition walls 4A to 4D defining three ink chambers 6A to 6C, including an ink chamber 6B of which ink discharge will be discussed. FIG. 5A is a diagram describing a relationship between a drive signal having a normal waveform, and a variation in pressure of ink in the ink chamber 6B being driven by the drive signal in the inlet head 1. In FIG. 5A, solid lines represent a waveform of the drive signal, and broken lines represent a varying pressure of ink in the ink chamber 6B. FIG. 5B is a diagram describing a transition in shape of a droplet of ink being propelled in the inkjet head 1 as driven with the drive signal shown in FIG. 5A.

In a steady state of the inkjet head 1 illustrated in FIG. 3A, assuming the drive signal shown by solid lines in FIG. 5A as being supplied thereto from the head driver 21 shown in FIG. 4, at the ink chambers 6A and 6C, their electrodes 11A and 11C are grounded at a time t1, and at the ink chamber 6B, the electrode 11B has a drive pulse P1 of a negative voltage (−VA) applied thereto. Then, at the partition walls 4B and 4C, their piezoelectric members 4*a* and 4*b* have electric fields developed in directions perpendicular to directions of polarization thereof. Paired piezoelectric members 4*a*, 4*b* and 4*a*, 4*b* are thereby caused to deform in a slipping manner along their joined end faces, so the partition walls 4B and 4C are deformed in directions to secede from each other as illustrated in FIG. 3B, with an increase developed in volume of the ink chamber 6B. There is a resultant decrease developed in pressure of ink in the ink chamber 6B, causing ink to inflow from the ink inlet 8 to the ink chamber 6B.

The drive pulse P1 applied is sustained for a duration AL (acoustic length) that is a period between the time t1 and a time t2 in FIG. 5A. At the ink chamber 6B with an increased volume, there is a pressure wave produced by inflow of ink, and propagated over length of the ink chamber 6B to a corresponding nozzle 7, taking an interval of time to be commensurate with an acoustic resonance period of ink chambers 6, of which half is referred to as AL. The magnitude of AL depends on among others structure of the inkjet head 1 and density of ink.

At the ensuing time t2, the electrode 11B in the ink chamber 6B has an electric potential returned to a ground level as a voltage applied thereto. Then, the partition walls 4B and 4C return from their states in FIG. 3B to those states (neutral states) illustrated in FIG. 3A. By that, at the ink chamber 6B, ink is pressurized to propel a droplet of ink through the nozzle 7. FIG. 5B illustrates a shape S1 as shape of a droplet of ink at a certain time in the course of development between the time t2 and a time t3.

At the ink chamber 6B, with a lapse of AL after the voltage applied to the electrode 11B has been returned to a ground potential, the electrode 11B has a drive pulse P2 of a positive voltage (VA) applied thereto and sustained for a period between the time t3 and a time t4 (as a duration AL). By that, as illustrated in FIG. 3C, the partition walls 4B and 4C are deformed in directions to close each other, with a contraction in volume of the ink chamber 613.

After application of the drive pulse P2, between the time t4 and a time t5 (non-depicted), the electrode 11B in the ink chamber 6B has a ground potential as a voltage applied thereto, to return to the state in FIG. 3A. FIG. 5B illustrates a shape S3 as shape of a droplet of ink at a certain time in the course of development after the time t4.

Such being the case, the normal waveform is adapted as a waveform of voltage to be applied to an electrode 11, to have associated partition walls 4 deform for making an ink chamber 6 enlarged in volume, followed by returning to an original volume thereof, followed by contracting this volume before returning again to the original volume.

It is noted that the inkjet head 1 of a share mode type employs deformation of partition walls 4 to propel droplets of ink as described, and is unable to simultaneously drive neighboring ink chambers for ink discharge. Therefore, the inkjet head 1 has a whole set of ink chambers 6 therein grouped into subsets thereof each composed of ink chambers simultaneously operable for discharge, and adapted for a time-division driving to individually drive such subsets of ink chambers for ink discharge to make a record.

First Embodiment

Figure 6A:
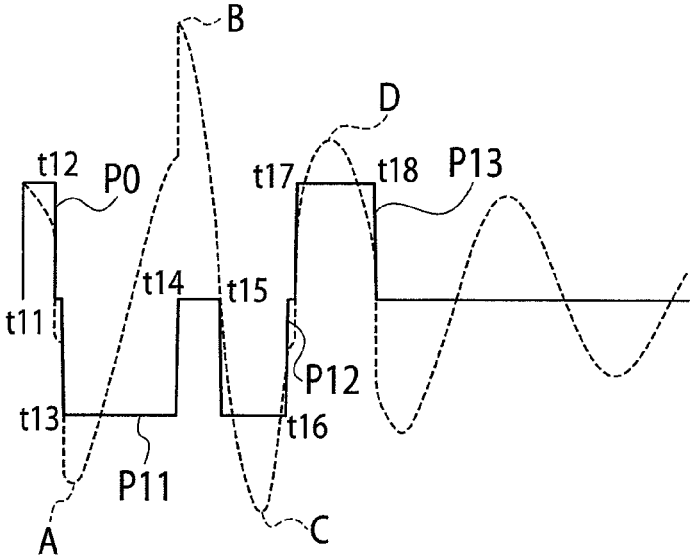
FIG. 6A is a diagram describing a relationship between a drive signal having a satellite controlling waveform according to a first embodiment, and a variation in pressure of ink in an ink chamber driven by the drive signal in the inlet head of FIG. 1.
Figure 6B:
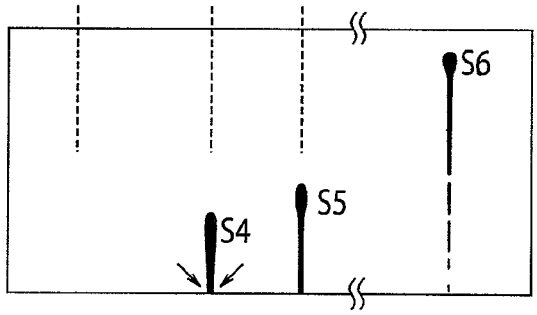
FIG. 6B is a diagram describing a transition in shape of a droplet of ink.

In such the inkjet printer, besides the normal waveform described, there is a satellite controlling waveform prepared as a waveform of voltage for driving an electrode 11, affording to more effectively suppress emission of satellites than using the normal waveform. FIG. 6A illustrates a satellite controlling waveform according to a first embodiment FIG. 6A describes a relationship between a drive signal that has the satellite controlling waveform according to the first embodiment, and a variation in pressure of ink in an ink chamber driven by the drive signal in the inkjet head 1. In FIG. 6A, solid lines represent the waveform of the drive signal, and broken lines represent a varying pressure of ink in the ink chamber. FIG. 6B is a diagram describing a transition in shape of a droplet of ink being propelled in the inkjet head 1 as driven with the drive signal shown in FIG. 6A.

In a steady state of the inkjet head 1 illustrated in FIG. 3A, assuming a drive signal using a satellite controlling waveform shown by solid lines in FIG. 6A as being supplied thereto from the head driver 21 shown in FIG. 4, at ink chambers 6A and 6C, their electrodes 11A and 11C are grounded at a time t11, and at an ink chamber 6B, its electrode 11B has a drive pulse P0 (as a preliminary pulse) of a positive voltage (VA) applied thereto. By that, as illustrated in FIG. 3C, the partition walls 4B and 4C are deformed in directions to close each other, with a contraction in volume of the ink chamber 6B.

At an ensuing time t12, the electrode 11B in the ink chamber 6B has an electric potential returned to a ground level as a voltage applied thereto. Then, the partition walls 4B and 4C return from their states in FIG. 3C to those states (neutral states) illustrated in FIG. 3A.

At a time t13 immediately after the time t12, the electrodes 11A and 11C in the ink chambers 6A and 6C are grounded, and the electrode 11B in the ink chamber 6B has a drive pulse P11 (as a first swelling pulse) of a negative voltage (−VA) applied thereto. By that, the partition walls 4B and 4C are deformed in directions to secede from each other as illustrated in FIG. 3B, with an increase developed in volume of the ink chamber 6B. There is a resultant decrease developed in pressure of ink in the ink chamber 6B, causing ink to inflow from the ink inlet 8 to the ink chamber 6B.

It is noted that, in use of the drive signal having the satellite controlling waveform, the drive pulse P11 applied is sustained for a duration AL (as a period between the time t13 and a time t14), like the drive pulse P1 in the drive signal having the normal waveform.

At the ensuing time t14, the electrode 11B in the ink chamber 6B has an electric potential returned to a ground level as a voltage applied thereto. Then, the partition walls 4B and 4C return from their states in FIG. 3B to the states (neutral states) illustrated in FIG. 3A. By that, at the ink chamber 6B, ink is pressurized to propel a droplet of ink through a corresponding nozzle 7.

At the ink chamber 6B, with a lapse of 0.4 AL after the voltage applied to the electrode 11B has been returned to a ground potential, the electrode 11B has a drive pulse P12 (as a second swelling pulse) of a negative voltage (−VA) applied thereto and sustained for a period of 0.6 AL between a time t15 and a time t16. By that, the partition walls 4B and 4C are deformed in directions to secede from each other as illustrated in FIG. 3B, with an increase developed in volume of the ink chamber 6B. FIG. 6B illustrates a shape S4 as shape of a droplet of ink at a certain time in the course of development between the time t15 and the time t16.

At the ensuing time t16, the electrode 11B in the ink chamber 6B has an electric potential returned to a ground level as a voltage applied thereto. Then, the partition walls 4B and 4C return from the states in FIG. 3B to the states (neutral states) illustrated in FIG. 3A.

At a time t17 after a very short time from the time t16 when the voltage applied to the electrode 11B in the ink chamber 6B was returned to a ground potential, the electrode 11B in the ink chamber 6B has a drive pulse P13 (as a contracting pulse) of a positive voltage (VA) applied thereto and sustained for a period of 0.75 AL between the time t17 and a time t18. By that, as illustrated in FIG. 3C, the partition walls 4B and 4C are deformed in directions to close each other, with a contraction in volume of the ink chamber 6B. FIG. 6B illustrates a shape S5 as shape of a droplet of ink at a certain time in the course of development between the time t17 and the time t18.

The ink chamber 6B has a pressure of ink therein amplified or raised by the drive pulse P12 applied to the electrode 11B in the ink chamber 6B, before the drive pulse P13 of the positive voltage (VA) applied to the electrode 11B in the ink chamber 6B. As this drive pulse P13 is applied to make the ink chamber 6B contract in volume, the ink chamber 6B after an 'off' of the drive pulse P12 (the time t16) has pressures of ink therein developed to a peak D of positive pressure enhanced with the drive pulse P13 turned on (at the time t17).

After application of the drive pulse P13, between the time t18 and a time t19 (non-depicted), the electrode 11B in the ink chamber 6B has a ground potential as a voltage applied thereto, to return to the state in FIG. 3A. FIG. 6B illustrates a shape S6 as shape of a droplet of ink at a certain time in the course of development after the time t18.

Here, as the drive pulse P13 is turned off (at the time t18) to have the ink chamber 6B enlarged in volume in the course for pressures of ink in the ink chamber 6B to return to a normal pressure past the peak D of positive pressure, it is hastened for pressures of ink in the ink chamber 6B to return from the peak D of positive pressure to the normal pressure.

Such being the case, the ink chamber 6B has pressures of ink therein developed with an 'on' of the drive pulse P12 (at the time t15) to a peak of negative pressure, followed by combination of an increase to a peak D of positive pressure and a quick decrease to a normal pressure, still before the ink chamber 6B has pressures of ink therein developed to a peak of negative pressure lower than the normal pressure.

Figure 7:
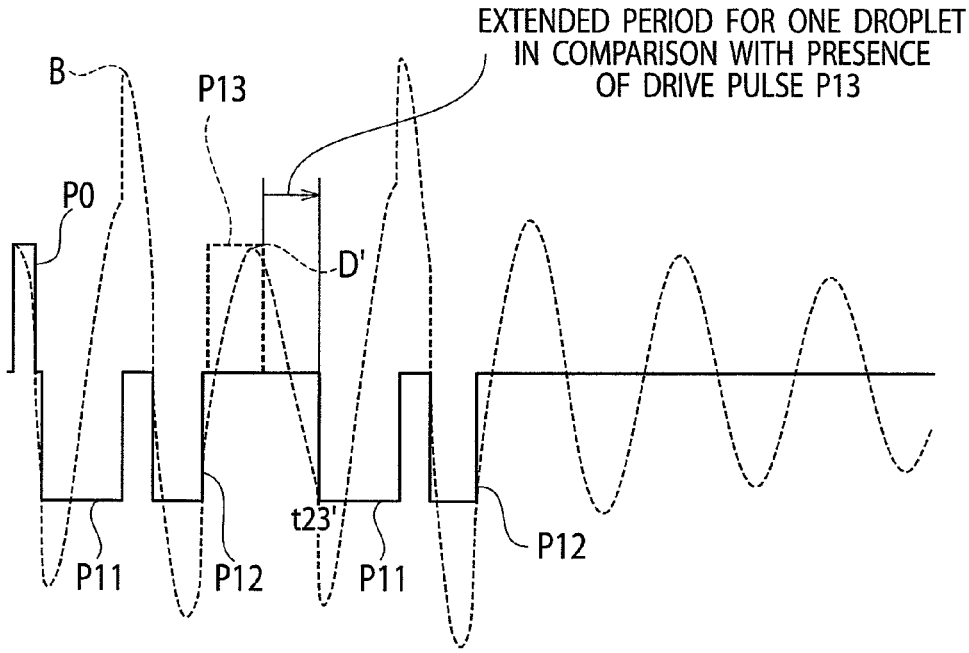
FIG. 7 is a diagram describing a drive signal modified from the satellite controlling waveform in FIG. 6A, by omitting a drive pulse serving for contraction of an ink chamber, and used for droplets of ink to be consecutively propelled out, and a relationship between the drive signal, and a variation in pressure of ink in the ink chamber being driven by the drive signal in the inkjet head of FIG. 1.

Namely, the ink chamber 6B has pressures of ink therein developed with an 'on' of the drive pulse P12 (at the time t15) to a peak of negative pressure and thereby rebounded to again increase up to such a peak of positive pressure (refer to a peak D in FIG. 8) as higher than a peak of positive pressure (refer to a peak D' in FIG. 7) in use of a pattern including a drive pulse P12 applied without an ensuing drive pulse P13.

Afterward, as a rebound of such the enhanced degree of increase in pressure, it has pressures of ink developed with an 'on' of a subsequent drive pulse P11 to such a peak of negative pressure as lower than that in use of a pattern including a subsequent drive pulse P11 turned on without an antecedent drive pulse P13 applied on the eve.

As a result, the ink chamber 6B has flux of ink taken therein with the former subsequent drive pulse P11 turned on, in a greater amount than in use of the pattern including the latter subsequent drive pulse P11 turned on without an antecedent drive pulse P13 applied, so the ink chamber 6B has pressures of ink therein rebounded to increase past the above-noted peak of negative pressure, and enhanced by pressurization of ink in the ink chamber 6B being contracted with that drive pulse P11 turned off, thus getting relatively high in pressure of ink.

Figure 8:
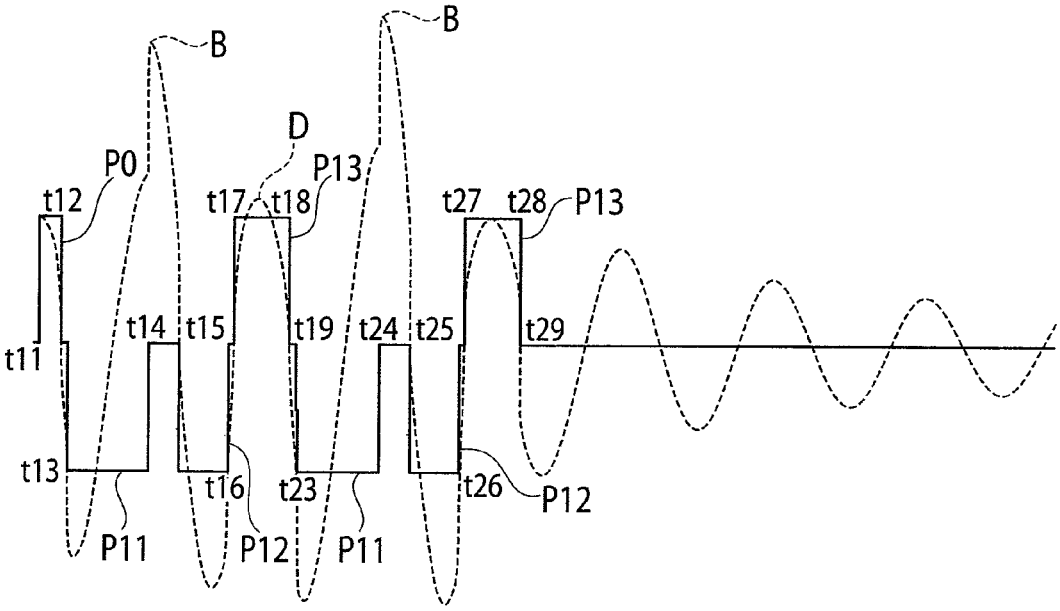
FIG. 8 is a diagram describing a drive signal having the satellite controlling waveform in FIG. 6A and used for droplets of ink to be consecutively propelled out, and a relationship between the drive signal, and a variation in pressure of ink in an ink chamber driven by the drive signal in the inkjet head of FIG. 1.

Further, as illustrated in FIG. 8, it undergoes application of a drive pulse P12 and an ensuing drive pulse P13, having pressures of ink rebounded to decrease past a peak D of positive pressure, and afterwards the drive pulse P13 is turned off, affording for pressures of ink in the ink chamber 6B to return to a normal pressure at a quicker timing than in use of the pattern (FIG. 7) free of drive pulse P13 applied.

Accordingly, for droplets of ink to be consecutively propelled out, there may well be use of a drive pulse P12 followed by application of a drive pulse P13 and consecutive application of a subsequent drive pulse P11, thereby permitting the subsequent drive pulse P11 to be turned on at a quicker timing (at a time t23 in FIG. 8) than in use of a pattern (FIG. 7) including a drive pulse P12 followed by a subsequent drive pulse P11 turned on without application of a drive pulse P13. This permits a second or any subsequent droplet of ink to be faster propelled out with an adequate pressure, allowing for an enhanced discharge performance when consecutively propelling droplets of ink.

It is noted that FIG. 8 includes a sequence of times t23 to t29 representing 'on' or 'off' timings of a sequence of drive pulses P11 to P13 in a drive signal for use to propel out a second droplet of ink in a course of consecutively propelling out droplets of ink. The drive signal with the sequence of times t23 to t29 has a waveform identical to that of the drive signal having a sequence of times t13 to t19 associated with the satellite controlling waveform as described with reference to FIG. 6A.

Such being the case, the satellite controlling waveform is adapted as a waveform of voltage to be applied to an electrode 11, to have associated partition walls 4 deform for making an ink chamber 6 enlarged in volume, followed by returning to an original volume thereof, followed by again enlarging this volume before again returning to the original volume, followed by contracting this volume before again returning to the original volume.

As illustrated by broken lines in FIG. 5A, the normal waveform of drive signal described is adapted to serve, with a start of application of a drive pulse P1 to the electrode 11B in the ink chamber 6B, to have pressures of ink in the ink chamber 6B develop as negative pressures, passing a peak of negative pressure, turned to increase, passing a normal pressure, and reach a peak of positive pressure at a time t2, where application of the drive pulse P1 ends. Propelling ink is thereby started. Along with propelling ink, the ink chamber 6B has pressures of ink tuned to decrease, passing the normal pressure, and reach a peak of negative pressure at a time t3, where application of a drive pulse P2 starts. With this, propelled ink affords for ink in the ink chamber 6B to be pressurized, with a controlled reduction in pressure, suppressing residual vibrations of ink. Such suppression of residual vibration permits a subsequent discharge action to be stable as described.

On the other hand, as illustrated by broken lines in FIG. 6A, the satellite controlling waveform of drive signal described is adapted to serve, with a start of application of a drive pulse P0 to the electrode 11B in the ink chamber 6B, to have pressures of ink in the ink chamber 6B develop as positive pressures, though being still insufficient to propel ink out of the ink chamber 6B through a corresponding nozzle 7. That is, the drive pulse P0 is adapted to cause a rebound to make the ink chamber 6B enlarged in volume, to have pressures of ink in the ink chamber 6B develop as relatively large negative pressures, upon application of an ensuing drive pulse P11 to the electrode 11B in the ink chamber 6B.

Namely, the satellite controlling waveform serves, with a start of application of the drive pulse P0 to the electrode 11B in the ink chamber 6B, to have pressures of ink in the ink chamber 6B develop as positive pressures, passing a peak of positive pressure, turned to decrease, and reach a normal pressure at a time t12, where application of the drive pulse P0 ends. Immediately thereafter, at a time t13, application of a drive pulse P11 to the electrode 11B in the ink chamber 6B starts. With this, as a rebound of positive pressures developed by application of the drive pulse P0, pressures of ink in the ink chamber 6B develop as relatively large negative pressures. Further, it serves, with a start of application of the drive pulse P11 to the electrode 11B in the ink chamber 6B, to have pressures of ink in the ink chamber 6B develop as negative pressures, passing a peak A of negative pressure, turned to increase, passing a normal pressure, and reach a peak B of positive pressure at a time t14, where application of the drive pulse P11 ends. Propelling ink is thereby started.

Like this, before the time t13 at which the drive pulse P11 of a negative voltage (−VA) is applied, there is a period between a time t11 and the time t12 in which the drive pulse P0 of a positive voltage (VA) is kept applied to the electrode 11B in the ink chamber 6B, whereby pressures of ink in the ink chamber 6B develop to an increased peak A of negative pressure. After the time t13, the ink chamber 6B has pressures of ink develop, passing the peak A of negative pressure, and tuned to increase, passing the normal pressure, entering into a positive pressure area, when the degree of increase in pressure of ink is enhanced, by a rebound of the increased peak A of negative pressure, to be greater than in use of a pattern free of drive pulse P0 applied in advance. As a result, at a time t14, pressures of ink have an enhanced peak B of positive pressure, allowing for an enhanced ink discharge performance.

After that, propelled ink causes negative pressures to develop in the ink chamber 6B, having pressures of ink in the ink chamber 6B turned to decrease, and return to the normal pressure at a time t15, when application of a drive pulse P12 to the electrode 11B in the ink chamber 6B starts, whereby the degree of decrease in pressure of ink in the ink chamber 6B gets amplified.

Then, the ink chamber 6B has pressures of ink therein develop to a peak C of negative pressure, when ink is forced, as illustrated in FIG. 6B, into a shape S4 of droplet having an ellipsoidal core slightly swelled at a front head portion continued to a rear tail portion. As apparent from comparison between the shape S4 of droplet and a shape S1 of droplet (FIG. 5B) at a corresponding time in the course of ink discharge using the normal waveform of drive signal in FIG. 5A, the satellite controlling waveform provides a head portion with a thinner bulge than the normal waveform. This is due to the ink chamber 6B working to intake ink with increased power after initiation of the propelling of ink. This permits emission of satellites to be controlled or suppressed when discharging ink, allowing for among others print quality degradation and device defacement to be suppressed.

Even if the degree of reduction in pressure of ink is amplified by application of the drive pulse P12, there is a pre-stage in which the drive pulse P0 and the ensuing drive pulse P11 are applied to have pressures of ink develop to an enhanced peak A of negative pressure and an ensuing enhanced peak B of positive pressure, allowing for adequate discharge of ink.

The satellite controlling waveform serves, with a start of application of the drive pulse P12 to the electrode 11B in the ink chamber 6B, to have pressures of ink in the ink chamber 6B develop, passing a peak C of negative pressure, turned to decrease, and return to the normal pressure at a time t16, immediately before a time t17 at which application of a drive pulse P13 to the electrode 11B in the ink chamber 6B starts. The drive pulse P13 applied causes a single occurrence of vibration at meniscus of ink in the nozzle 7 at the ink chamber 6B. That is, application of the drive pulse P13 does not directly cause ink to be discharged from the nozzle 7.

Then, the ink chamber 6B has pressures of ink therein develop to a peak D of positive pressure, when ink is forced into a shape S5 of droplet illustrated in FIG. 6B. As apparent from comparison between the shape S5 of droplet and a shape S2 of droplet (FIG. 5B) at a corresponding time in the course of ink discharge using the normal waveform of drive signal in FIG. 5A, the satellite controlling waveform provides a tail portion with a thinner size than the normal waveform. This is due to the ink chamber 6B working to intake ink with increased power after initiation of the propelling of ink, causing the tail portion to be thinned and additionally extended thereafter. Further, as application of the drive pulse P13 ends at a time t18 after a lapse of 0.75 AL from the start of application of the drive pulse P13, pressures of ink in the ink chamber 6B, which have developed passing the peak D of positive pressure and turned to decrease, return to the normal pressure at a hastened timing. This shortens the period of variation in pressure of ink of which the amplitude of variation has been increased with the peak C of negative pressure increased by application of the drive pulse P12, allowing for a hastened start of subsequent ink discharge actions.

After application of the drive pulse P13 in the satellite controlling waveform of drive signal, in due course, ink is forced into a shape S6 of droplet illustrated in FIG. 6B. As apparent from comparison between the shape S6 of droplet and a shape S3 of droplet (FIG. 5B) at a corresponding time in the course of ink discharge using the normal waveform of drive signal in FIG. 5A, the satellite controlling waveform provides a tail portion with a significant thinner size than the normal waveform. This also is due to the ink chamber 6B working to intake ink with increased power after initiation of the propelling of ink. Such the thinning of a tail portion of a droplet of ink permits emission of satellites to be suppressed thereafter. More specifically, there is a droplet of ink shaped with a thinned tail portion reduced in amount of ink that may constitute satellites, and even if the tail portion is torn, resultant satellites should be small in particle diameter. Therefore, satellites on a recording sheet should be insignificant, affording to feel suppressed satellite emission in visual sense, as well.

The satellite controlling waveform of drive signal described has set up, for the drive pulse P11, a pulse width of AL (time t13 to time t14), for the drive pulse P12, a pulse width of 0.6 AL (time t15 to time t16), for the drive pulse P13, a pulse width of 0.75 AL (time t17 to time t18), and for the period between the end of application of the drive pulse P11 and the end of application of the drive pulse P12, an interval of 1.0 AL (time t14 to time t16). However, there may be combination of a drive pulse P11 with a pulse width within a range of 0.9 AL to 1.2 AL, a drive pulse P12 with a pulse width within a range of 0.5 AL to 0.7 AL, a drive pulse P13 with a pulse width within a range of 0.6 AL to 0.8 AL, and an interval a range of 0.8 AL to 1.1 AL as a period between an end of application of the drive pulse P11 and an end of application of the drive pulse P12.

It is undesirable for the start of application of the drive pulse P12 to be set too close to the end of application of the drive pulse P11. Or else, three may appear defective discharge such as a lowered ink discharge speed or a failed discharge.

In the satellite controlling waveform of drive signal described, the drive signal P11 is adapted to serve, with an end of application of the drive pulse P11, to have pressures of ink in the ink chamber 6B develop to a peak B of positive pressure, turned to decrease, and return to a normal pressure at a time t15, when application of the drive signal P12 starts. However, there may be use of a drive pulse P12 adapted to start application at any timing else than the time t15, in the course in which pressures of ink decrease from a peak B of positive pressure to a peak C of negative pressure. By doing so, pressures of ink in the ink chamber 6B turned to decrease after an end of application of the drive pulse P11 can reach an enhanced peak C of negative pressure, allowing suppression of satellite emission to be implemented with increased power to take in ink.

The satellite controlling waveform of drive signal described is adapted to serve, with a start of application of the drive signal P12, to have pressures of ink in the ink chamber 6B develop passing a peak C of negative pressure, and return to a normal pressure at the time t16, when application of the drive signal P12 ends, immediately before the time t17, when application of the drive signal P13 starts. However, it may be adapted to serve to end application of a drive pulse P12 and start application of a drive P13 at timings else than the time t16 and t17, in the course in which pressures of ink increase from a peak C of negative pressure after a start of application of the drive pulse P12 to an ensuing peak D of positive pressure. By doing so, the increase in pressure of negative value due to the start of application of the drive pulse P12 can be kept free from interference with the end of application of the drive pulse P12.

The timing of 'off' (end of application) of the drive pulse P13 may be any timing else than the time t18, within a period in which pressures of ink in the ink chamber 6B return from the peak D of positive pressure (refer to FIG. 8) to the normal pressure.

By the way, in regard of the start of application of the drive pulse P12, it is desirable that the satellite controlling waveform of drive signal has the interval between the drive pulse P11 and the drive pulse P12 set to ⅖ of width the drive pulse P11. It therefore is desirable for the timing of the start of application of the drive pulse P12 to be a timing meeting that relationship. Further, in such the case, it is desirable that width of the drive pulse P12 is set to ⅗ of width of the drive pulse P11. FIG. 9 lists such relationships as being desirable.

FIG. 9 is a table listing different patterns each having a fixed interval between a first swelling pulse and a second swelling pulse varied in width, comparing properties associated with ink discharge. More specifically, it lists results of evaluations of satellite controlling performance and ink discharge performance, and total evaluation, for patterns having drive pulses P12 different in width, providing ⅖ of a width of drive pulses P11 as identical to each interval (time t14 to time t15) between drive pulse P11 and drive pulse P12 that corresponds to an interval between a first swelling pulse and a second swelling pulse.

As shown in FIG. 9, drive pulses P11 had a width of 2500 ns, and each interval between drive pulse P11 and drive pulse P12 was set to 1000 ns being ⅖ of the width, and drive pulses P12 had widths of 800, 1000, 1200, 1400, 1500, 1600, 1800, and 2000 ns. There were evaluations made of satellite controlling performance and ink discharge performance.

As a result, the satellite controlling performance was good on widths of drive pulses P12 within a range of 1400 ns or more, and very good within a range of 1500 ns or more. But, on widths of drive pulses P12 within a range of 800 to 1200 ns, there were observed no good results, for deficient ink in-taking power after ink discharge (too small peak C of negative pressure of ink).

For the ink discharge performance, there were good results obtained on widths of drive pulses P12 within a range of 1500 ns or less. But, on widths of drive pulses P12 within a range of 1800 ns or more, there were observed no good results, for deficient ink discharge speeds. On widths of drive pulses P12 of 1800 ns and 2000 ns, there were observed no good results, for air inclusion due to excessive in-taking power (too large peak C of negative pressure of ink).

In a total evaluation of the satellite controlling performance and the ink discharge performance, it appeared that there was a most favorable result obtained on width of drive pulse P12 of 1500 ns.

The viscosity of ink depends on temperature of ink. That is, the lower the ink temperature, the higher the ink viscosity, with increase in fluid resistance of ink, and decrease in fluidity of ink. To the contrary, the higher the ink temperature, the lower the ink viscosity. To this point, there may be corrections in accordance with temperature of ink or ambient temperature of the inkjet head 1, such as those of widths of drive pulses P0, P11, P12, and/or P13, or interval (time t14 to time t15) between drive pulse P11 and drive pulse P12. The temperature of ink or the ambient temperature of the inkjet head 1 may be detected at the temperature detector 22.

More specifically, as shown in FIG. 10, the drive pulse P0 may have a pulse width corrected to be a little longer when the ink temperature is lower than a criterion or standard, or corrected to be a little shorter when the ink temperature is higher than the criterion or standard. For other drive pulses P11, P12, and P13 as well as interval between drive pulses P11 and P12, their pulse widths or interval may be corrected to be a little shorter when the ink temperature is lower than the criterion or standard, or corrected to be a little longer when the ink temperature is higher than the criterion or standard. By doing so, ink discharge can be controlled in accordance with ink fluidity commensurate with ink temperature, affording to suppress emission of satellites.

According to the first embodiment, there is a implementation of printing using a drive signal with a satellite controlling waveform such that, between a peak B of positive pressure of ink developed by application of a drive pulse P11 in the drive signal and a peak C of negative pressure of ink ensuing therefrom, there starts application of a drive pulse P12 as a second swelling pulse, and between the peak C of negative pressure and a peak D of positive pressure of ink ensuing therefrom, there ends application of the second drive pulse P12. This allows for an enhanced efficiency in suppression of satellite emission, without disturbing ink discharge performance at an associated nozzle 7.

In use of the satellite controlling waveform of drive signal, there is application of the drive pulse P12 serving for amplification of a peak C of negative pressure of ink immediately after discharge of ink, to increase ink in-taking power after ink discharge, thereby controlling emission of satellites. However, there may be configurations substituting such the application of drive pulse P12 with use of a normal waveform modified in pulse width of drive pulses P1 and P2 and/or interval between drive pulses P1 and P2, to control emission of satellites. There will be described embodiments of such configurations.

Second and Third Embodiments

Description is now made of inkjet printers according to embodiments (second and third embodiments) of the present invention adapted to work, even under low temperature environments, to reduce emission of satellites, allowing for a shortened printing of images. Those inkjet printers have a configuration illustrated in FIGS. 1 to 4, including an inlet head configured for actions illustrated in FIGS. 3A to 3C. The inkjet head is adapted to be driven by selective use of a drive signal that has a normal waveform illustrated in FIG. 5A, and drive signals that have satellite controlling waveforms according to the second and third embodiments, respectively, which will be described with reference to FIG. 11 and FIG. 12.

Figure 11:
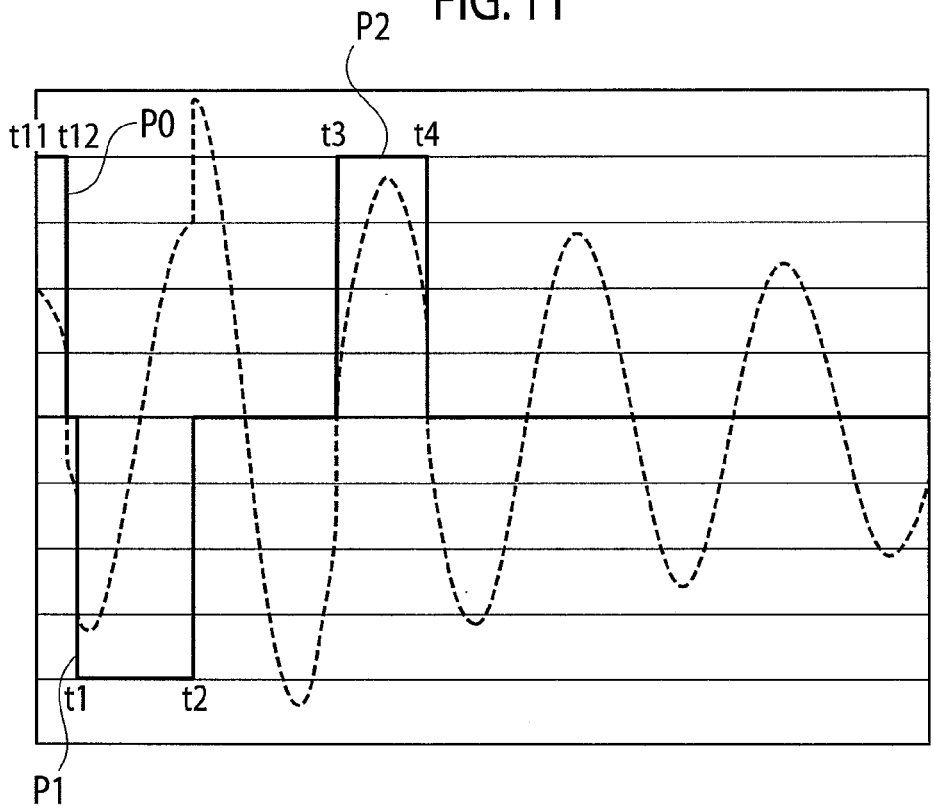
FIG. 11 is a diagram describing a relationship between a drive signal having a satellite controlling waveform according to a second embodiment, and a variation in pressure of ink in an ink chamber driven by the drive signal in the inkjet head of FIG. 1.
Figure 12:
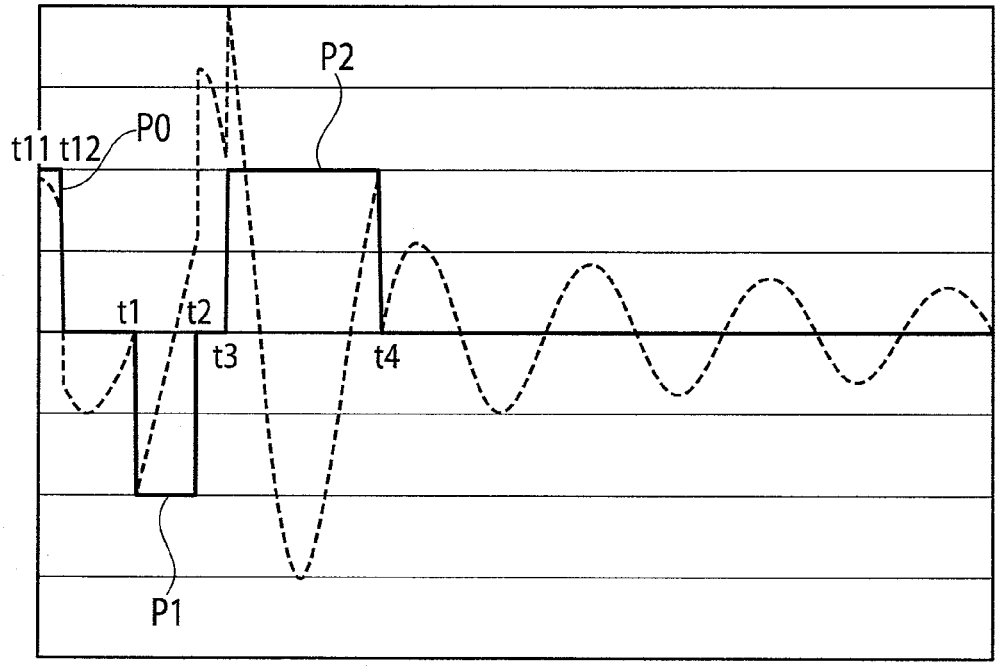
FIG. 12 is a diagram describing a relationship between a drive signal having a satellite controlling waveform according to a third embodiment, and a variation in pressure of ink in an ink chamber driven by the drive signal in the inkjet head of FIG. 1.

In FIG. 11 as well as in FIG. 12, solid lines represent a waveform of drive signal, and broken lines represent a varying pressure of ink in an ink chamber. It is noted that also the satellite controlling waveforms of the drive signals shown in FIGS. 11 and 12 each have a drive pulse P0 inserted before a drive pulse P1, for a similar reason to the satellite controlling waveform of the drive signal shown in FIG. 6A.

FIG. 11 is a diagram describing a relationship between a drive signal having a satellite controlling waveform according to the second embodiment, and a variation in pressure of ink in an ink chamber in an inkjet head driven by the drive signal. This satellite controlling waveform of drive signal has a drive pulse P1 and a drive pulse P2 corresponding to those in the normal waveform described, subject to combination of a pulse width of the drive pulse P1 and an interval between the drive pulses P1 and P2 set longer than in the normal waveform. More specifically, the pulse width of the drive pulse P1 and the interval between the drive pulses P1 and P2 have a total period thereof extended from a sum of 2.0 AL in the normal waveform to a value within a range of 2.4 to 2.5 AL. By doing so, after discharge of ink, the ink chamber has pressures of ink therein retained negative over an extended period, so ink in-taking power after the ink discharge is enhanced relative to the normal waveform, allowing for suppressed emission of satellites.

FIG. 12 is a diagram describing a relationship between a drive signal having a satellite controlling waveform according to the third embodiment, and a variation in pressure of ink in an ink chamber in an inkjet head driven by the drive signal. This satellite controlling waveform of drive signal has a drive pulse P1 and a drive pulse P2 corresponding to those in the normal waveform described, subject to combination of a pulse width of the drive pulse P1 set shorter, an interval between the drive pulses P1 and P2 set shorter, and a pulse width of the drive pulse P2 set longer. This arrangement serves to have double-staged peaks of positive pressure of ink after application of the drive pulse P1 has started. By doing so, the application of the drive pulse P1 is ended at a hastened timing relative to the normal waveform, with the more quickened changes in pressure of ink from a peak of negative pressure through a normal pressure to a positive pressure range, affording to shorten the period of variation in pressure of ink at the time of ink discharge. Further, the ending of application of the drive pulse P1 followed by changes in pressure of ink from negative pressure to positive pressure is immediately followed by a start of application of the drive pulse P2, affording to quicken also changes in pressure of ink from the positive pressure range through the normal pressure to a negative pressure range. This shortens the ink discharge period, and the ink in-taking power after ink discharge also is enhanced relative to the normal waveform, allowing for suppressed emission of satellites.

Figure 13:
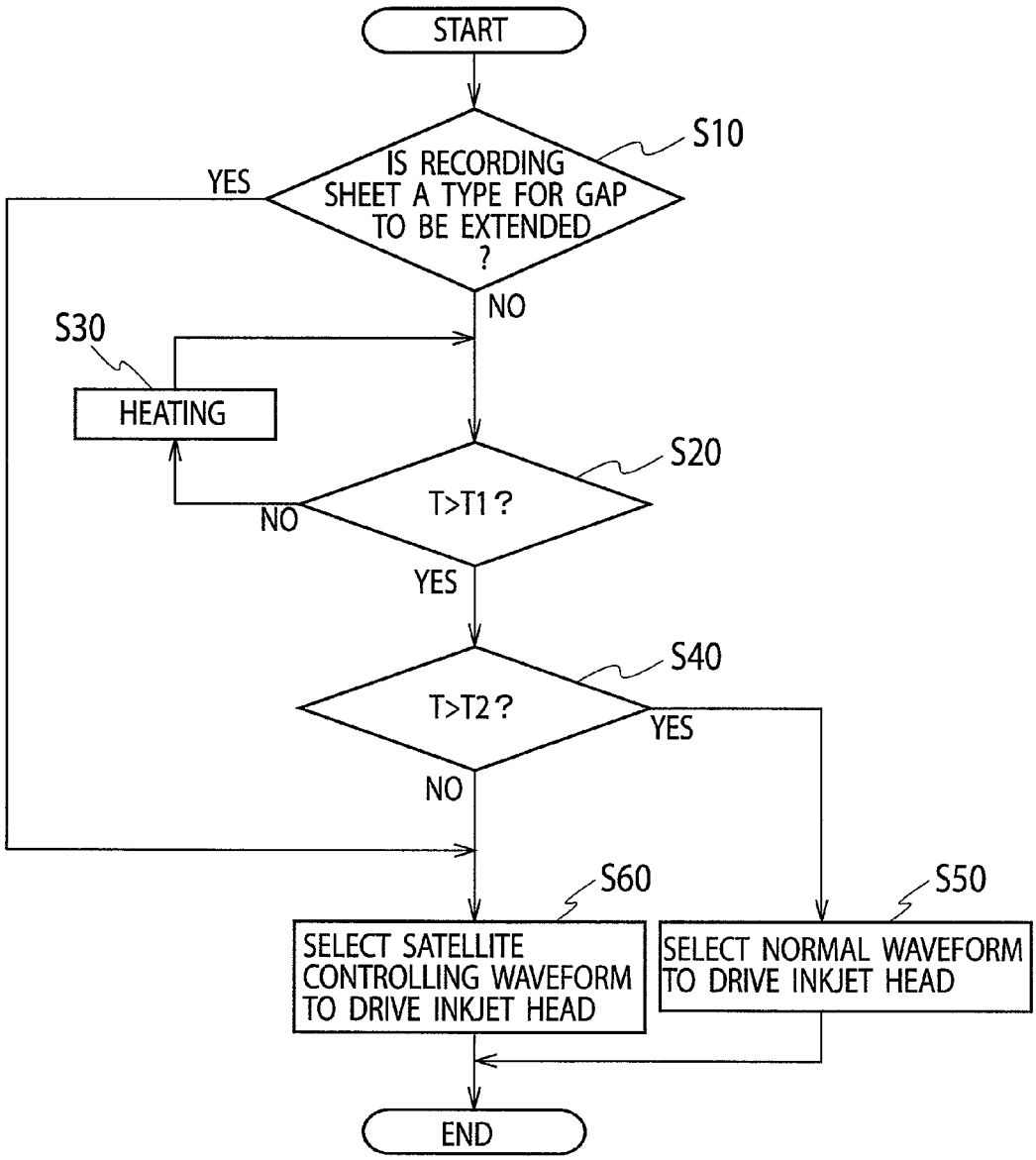
FIG. 13 is a flowchart of actions in a recording in the inkjet printer according to the mode of embodiment described.

The foregoing satellite controlling waveforms of drive signals are each employable for printing image data, through control actions of the controller 26 shown in a flowchart of FIG. 13, for instance. In the flowchart of FIG. 13, the controller 26 works in accordance with, among others, the type of recording sheet used and the temperature of ink available, to determine a normal waveform of drive signal or a satellite controlling waveform of drive signal, whichever is to be used. As used herein, the term "gap" means a distance between the inkjet head 1 and a recording medium transferred thereunder.

At a step S10, given a frame of image data to be recorded, and a set of operational data including data on a recording sheet for the frame of image data to be printed thereon, the controller 26 determines whether or not the recording sheet is of any type that needs the gap between the print head 1 and the recording sheet to be larger than a normal gap. Types of recording sheet enumerated as needing the gap to be larger than the normal gap may include a pouched recording sheet such an envelope, for instance. Such the check for the type of recording sheet at the step S10 may be substituted with a direct check to determine if the print is of any setting that requires the gap between the print head 1 and the recording sheet to be increased.

If the recording sheet is of a type that needs the gap to be larger than the normal gap (YES at the step S10), then the control flow goes to a later-described step S60. Unless the recording sheet is of any type that needs the gap to be larger than the normal gap (NO at the step S10), then the control flow goes to a step S20, where the controller 26 determines whether or not a temperature T of ink detected at the temperature detector 22 is higher than a head usable temperature T1. If the temperature T is equal to or lower than the head usable temperature T1 (NO at the step S20), then the inkjet head 1 is prohibited to enter any recording action, so the control flow goes to a step S30, where the controller 26 works to control the heater 23 to enter a warm-up operation for heating ink to be supplied to the inkjet head 1. Afterward, the control flow again goes to the step S20. The head usable temperature T1 may be set to 20° C. or near, for instance.

If the temperature T is higher than the head usable temperature T1 (YES at the step S20), the control flow goes to a step S40, where the controller 26 determines whether or not the temperature T is higher than a normal usable temperature T2. The normal usable temperature T2 is set as a higher temperature than the head usable temperature T1. If the temperature T is higher than the normal usable temperature T2 (YES at the step S40), the control flow goes to a step S50. If the temperature T is equal to or lower than the normal usable temperature T2 (NO at the step S40), the control flow goes to a step S60. The normal usable temperature T2 may be set to 25° C. or near, for instance.

At the step S50, the controller 26 reads waveform data of a normal waveform in the driving waveform memory 24, and works on bases of the given frame of image data and the waveform data of the normal waveform, to control the head driver 21 to drive ink chambers 6 to be driven in the inkjet head 1 to propel out droplets of ink, as necessary. Image data include data on the number of drops at each pixel, and a sequence of such propelling actions as described with reference to FIG. 3 is performed at a respective ink chamber 6 depending on the drop number.

At the step S60, the controller 26 reads waveform data of a satellite controlling waveform in the driving waveform memory 24, and works on bases of the given frame of image data and the waveform data of the satellite controlling waveform, to control the head driver 21 to drive ink chambers 6 to be driven in the inkjet head 1 to propel out droplets of ink, as necessary. The satellite controlling waveform used may be any one of the satellite controlling waveform of drive signal shown in FIG. 6, and the satellite controlling waveforms of drive signals shown in FIG. 11 and FIG. 12.

The flowchart in FIG. 13 may be modified for the control flow to go, when NO at the step S10, unconditionally to the step S50, or for omission of the step S10 to start at the step S20. Or else, the flowchart in FIG. 13 may be modified for emission of all intervening steps to respond to every image data input, by unconditionally proceeding to the step S60 to make actions required there without exception.

According to the embodiments described, there is a droplet propelling device adapted to work for negative pressures of ink developed after ink discharge, to turn on a second swelling pulse to thereby amplify a peak of negative pressure, to increase power for the ink chamber to take in ink, and prevent the increase from being affected by an 'off' of the second swelling pulse, allowing for an enhanced efficiency in suppression of satellite emission without interfering with the ink-discharging performance of nozzle.

Further, the ink chamber has pressures of ink therein develop from the peak of negative pressure to an ensuing peak of positive pressure, undergoing a contracting pulse turned on with a contraction in volume of the ink chamber, so the peak of positive pressure being developed in the ink chamber after the 'off' of the second swelling pulse is enhanced.

The ink chamber has pressures of ink therein develop, passing the ensuing peak of positive pressure, and return a normal pressure, undergoing the contracting pulse turned off with an increase in volume of the ink chamber, so pressures of ink in the ink chamber can return from the ensuing peak of positive pressure to the normal pressure at a hastened timing.

Such being the case, the ink chamber has pressures of ink therein develop with the help of an 'on' of the second swelling pulse, to reach a peak of negative pressure, increase therefrom to an ensuing peak of positive pressure, and quickly decrease to a normal pressure, so still afterward the ink chamber can have pressures of ink therein attain a peak of negative pressure lower than the normal pressure.

Accordingly, the ink chamber has pressures of ink therein developed with an 'on' of the second swelling pulse to a peak of negative pressure and thereby rebounded to again increase, with a greater degree of increase in pressure of ink (i.e. up to a peak of positive pressure higher) than in use of a pattern including a second swelling pulse applied without an ensuing contracting pulse.

Afterward, as a rebound of such the enhanced degree of increase in pressure, the ink chamber has pressures of ink therein developed with an 'on' of a subsequent first swelling pulse to a peak of negative pressure lower than that in use of a pattern including a subsequent first swelling pulse turned on without an antecedent contracting pulse turned on.

As a result, the ink chamber has flux of ink taken therein with the subsequent first swelling pulse turned on, in a greater amount than in use of the pattern having no antecedent contracting pulse turned on, so the ink chamber has pressures of ink therein rebounded to increase past the peak of negative pressure, and enhanced by pressurization of ink in the ink chamber being contracted with the first swelling pulse turned off, getting relatively high in pressure of ink.

Further, the ink chamber undergoes application of a second swelling pulse and an ensuing contracting pulse, and has pressures of ink therein, as having been increased with an 'off' of the second swelling pulse, rebounded to decrease past a peak of positive pressure, and afterwards the contracting pulse is turned of affording for pressures of ink in the ink chamber to return to a normal pressure at a quicker timing than in use of the pattern having no antecedent contracting pulse turned on.

Accordingly, there may well be use of a second swelling pulse followed by application of a contracting pulse and consecutive application of a subsequent first swelling pulse, thereby permitting, among droplets of ink to be consecutively propelled out, a second or any subsequent droplet of ink to be faster propelled out with an adequate pressure, allowing for an enhanced discharge performance when consecutively propelling droplets of ink.

Further, according to the embodiments described, there is a droplet propelling device adapted to serve for a printing of a multi-drop system propelling a plurality of droplets onto an identical pixel to provide the pixel with a gradation, permitting a second or any subsequent droplet of ink to be consecutively propelled out with ensured faster discharge actions.

Further, according to the embodiments described, there is a droplet propelling device adapted to turn on a preliminary pulse to have pressures of ink in an ink chamber once pressurized, to make use of a rebound thereof to raise ink pressures (inclusive of as a peak of positive pressure) when discharging ink, allowing for an enhanced discharge performance.

Further, according to the embodiments described, there is a droplet propelling device adapted to work in accordance with a variation in temperature of ink or ink chamber accompanied by a variation in viscosity of ink, to implement a regulation of waveform of a drive signal, allowing for efficient suppression of satellite emission.

Further, according to the embodiments described, there is a droplet propelling device configured to work in consideration of, among others, such working environment and working mode of a printer that may have influences on degradation of print quality due to emission of satellites in discharge of ink, to select a drive signal adapted to control emission of satellites, for implementation of ink discharge with an ensured suppression of satellite emission.

The present application claims the benefit of priority under 35 U.S.C. §119 to Japanese Patent Application No. 2010-

041785, filed on Feb. 26, 2010, the entire contents of which is incorporated herein by reference.

What is claimed is:

1. A droplet propelling device adapted to propel droplets of ink through a nozzle, the droplet propelling device comprising:

a pressure regulator configured to cause changes in volume of an ink chamber communicating with the nozzle to make increases and decreases in pressure of ink in the ink chamber; and a driver configured to generate a drive signal, and use the drive signal to drive the pressure regulator, the drive signal having a satellite controlling waveform including a first swelling pulse adapted to serve for use of the pressure regulator to cause an increase in volume of the ink chamber for a constant period, a second swelling pulse adapted to serve after an end of the first swelling pulse, interposing a prescribed interval in between, for use of the pressure regulator to cause another increase in volume of the ink chamber for a constant period, and a contracting pulse adapted to serve after an 'off' of the second swelling pulse for use of the pressure regulator to cause a decrease in volume of the ink chamber for a constant period, wherein the driver is configured to turn the second swelling pulse on in a first period that is a period from a first positive pressure peak being a peak of increase in pressure of ink in the ink chamber caused by the first swelling pulse turned on or off to a first negative pressure peak being a peak of decrease in pressure of ink ensuing therefrom, and turn the second swelling pulse off in a second period that is a period from the first negative pressure peak to a second positive pressure peak being a peak of increase in pressure of ink ensuing therefrom, the driver is configured to work in the second period to turn the contracting pulse on after an off of the second swelling pulse, and turn the contracting pulse off in a period for restoration in pressure of ink in the ink chamber from the second positive pressure peak to a normal pressure value, the contracting pulse enhances the second positive pressure peak and brings forward a timing of restoration to the normal pressure value, and the driver is configured to work simply in a multi-droplet operation for droplets of ink to be consecutively propelled onto an identical dot, to generate the drive signal including the contracting pulse.

2. The droplet propelling device according to claim 1, wherein the driver is configured to generate the drive signal including before an on of the first swelling pulse a preliminary pulse adapted to serve for use of the pressure regulator to cause a decrease in volume of the ink chamber for a constant period.

3. The droplet propelling device according to claim 1, further comprising:

a temperature detector configured to detect a temperature of ink to be supplied to the ink chamber; and a waveform corrector configured to work depending on, a result of detection at the temperature detector, to correct a pulse width or a pulse interval of the drive signal.

4. The droplet propelling device according to claim 1, further comprising a controller configured to determine to or not to supply the drive signal to the pressure regulator depending on one or more of a temperature of ink to be supplied to the ink chamber, a distance from the nozzle to a recording sheet, and a type of the recording sheet, wherein the controller is configured to work when having determined to supply the drive signal to the pressure regulator, to have the driver generate the drive signal.

* * * * *